US008878510B2

(12) United States Patent
Bhattacharyya et al.

(10) Patent No.: US 8,878,510 B2
(45) Date of Patent: Nov. 4, 2014

(54) REDUCING POWER CONSUMPTION IN A VOLTAGE REGULATOR

(75) Inventors: Prasun Kali Bhattacharyya, Bangalore (IN); Prakash Easwaran, Bangalore (IN)

(73) Assignee: Cadence AMS Design India Private Limited, Bangalore, Kamataka (IN)

( * ) Notice: Subject to any disclaimer, the term of this patent is extended or adjusted under 35 U.S.C. 154(b) by 140 days.

(21) Appl. No.: 13/472,461

(22) Filed: May 15, 2012

(65) Prior Publication Data

US 2013/0307502 A1 Nov. 21, 2013

(51) Int. Cl.
*G05F 3/08* (2006.01)

(52) U.S. Cl.
USPC ..... 323/314; 323/316

(58) Field of Classification Search
USPC ..... 323/273–281, 311–317
See application file for complete search history.

(56) References Cited

U.S. PATENT DOCUMENTS

| | | | | |
|---|---|---|---|---|
| 5,869,989 | A * | 2/1999 | Furuya et al. | 327/112 |
| 8,471,538 | B2 * | 6/2013 | Pancholi et al. | 323/274 |
| 8,508,199 | B2 * | 8/2013 | Arigliano et al. | 323/277 |
| 2007/0216382 | A1 * | 9/2007 | Lin et al. | 323/273 |
| 2010/0066320 | A1 * | 3/2010 | Dasgupta et al. | 323/273 |

FOREIGN PATENT DOCUMENTS

IN 2653/CHE/2010 7/2012

* cited by examiner

*Primary Examiner* — Nguyen Tran
(74) *Attorney, Agent, or Firm* — Rosenberg, Klein & Lee

(57) ABSTRACT

A voltage regulator includes an amplifier, a first buffer and a second buffer. The amplifier is designed to generate an error voltage between a reference voltage and a voltage at an output node of the voltage regulator. The first buffer is coupled to receive the amplified error voltage and, in response, to drive a first pass transistor. The first buffer includes a non-linear resistance element. The resistance of the non-linear resistance element varies non-linearly with a load current drawn from the output node. The second buffer is coupled to receive the amplified error voltage, and in response, to drive a second pass transistor. The second buffer includes a linear resistance element. The resistance of the linear element is a constant. The use of the non-linear resistance element enables reduction in power consumption in the voltage regulator.

16 Claims, 6 Drawing Sheets

REDUCING POWER CONSUMPTION IN A VOLTAGE REGULATOR

BACKGROUND

1. Technical Field

Embodiments of the present disclosure relate generally to voltage regulators, and more specifically to techniques for reducing power consumption in a voltage regulator.

2. Related Art

A voltage regulator generally refers to a device that receives an unregulated voltage as input, and generates a regulated voltage as an output. As is well known, unregulated voltages generally drop when large currents are drawn (from the source of the unregulated voltage), while regulated voltages are generally provided at the substantially same rated value for a large range of currents drawn. In general, most systems require regulated voltage as sources of power.

A voltage regulator may contain one or more components internally that operate(s) to generate the regulated output voltage. Such components may include, for example, amplifiers, buffers, etc. The internal components used in a voltage regulator may consume power in performing corresponding operations. It may be desirable to reduce such power consumption in a voltage regulator.

BRIEF DESCRIPTION OF THE VIEWS OF DRAWINGS

Example embodiments will be described with reference to the accompanying drawings briefly described below.

The drawing in which an element first appears is indicated by the leftmost digit(s) in the corresponding reference number.

DETAILED DESCRIPTION

1. Overview

A voltage regulator according to an aspect of the present invention includes an amplifier, a first buffer and a second buffer. The amplifier is designed to generate an error voltage between a reference voltage and a (output) voltage at an output node of the voltage regulator. The first buffer is coupled to receive the error voltage and, in response, to drive a first pass transistor. The first buffer includes a non-linear resistance element. The resistance of the non-linear resistance element varies non-linearly with a load current drawn from the output node of the voltage regulator. The second buffer is coupled to receive the error voltage, and in response, to drive a second pass transistor. The second buffer includes a linear resistance element. The resistance of the linear element is constant and does not vary with the load current drawn from the output node of the voltage regulator.

Several aspects of the invention are described below with reference to examples for illustration. It should be understood that numerous specific details, relationships, and methods are set forth to provide a full understanding of the invention. One skilled in the relevant arts, however, will readily recognize that the invention can be practiced without one or more of the specific details, or with other methods, etc. In other instances, well-known structures or operations are not shown in detail to avoid obscuring the features of the invention.

2. Voltage Regulator

Figure 1:
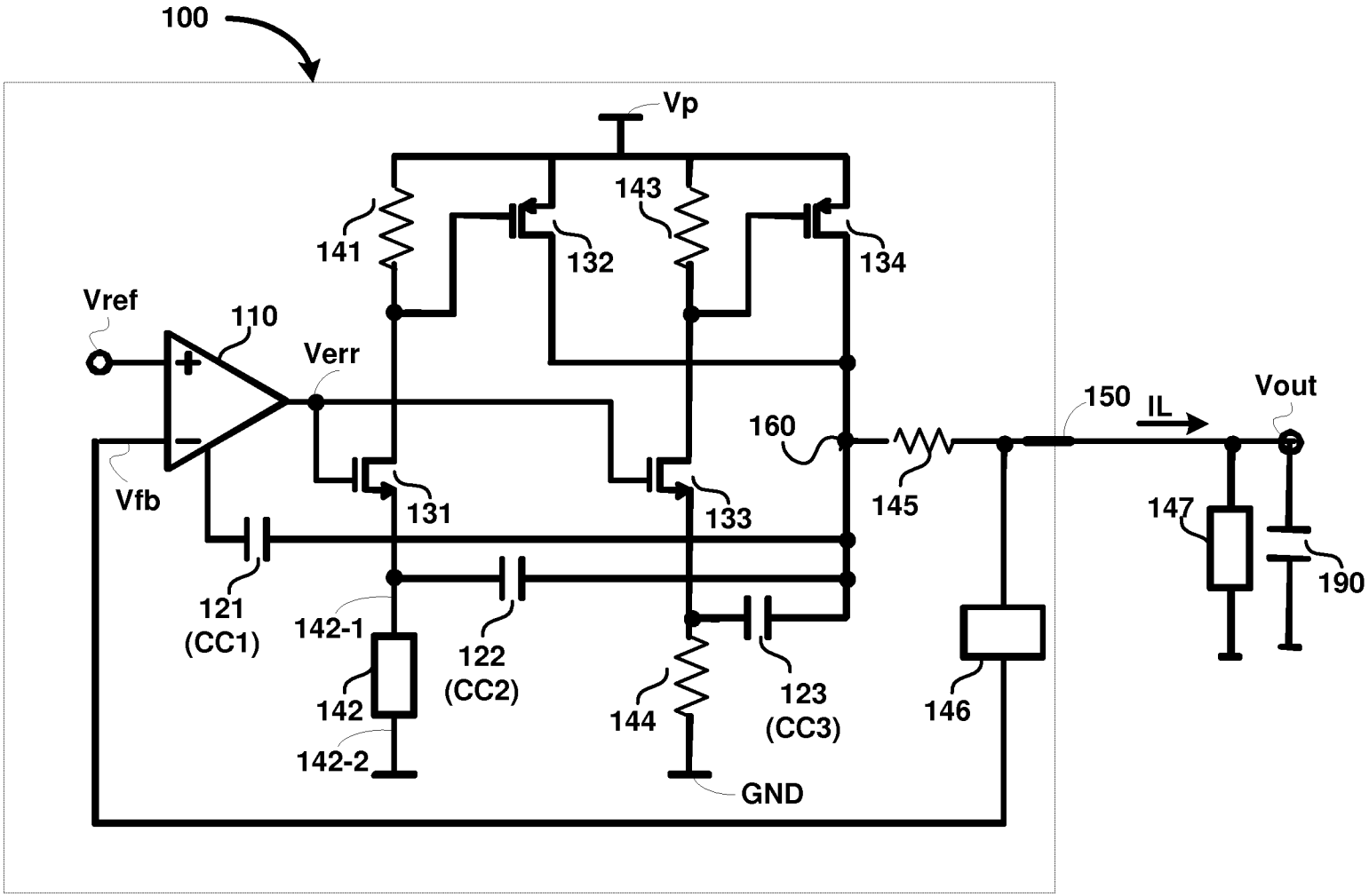
FIG. 1 is a circuit diagram illustrating the details of a voltage regulator in an embodiment of the present invention.

FIG. 1 is a circuit diagram illustrating the details of a voltage regulator in an embodiment of the present invention. Low drop-out regulator (LDO) 100 is shown containing amplifier 110, buffer (A) formed by resistor 141, transistor 131 and non-linear resistance element 142, buffer (B) formed by resistor 143, transistor 133 and linear resistance 144, pass transistors 132 and 134, feedback block 146, and capacitors 121, 122, and 123.

Transistors of FIG. 1 shown to be CMOS transistors, though alternative embodiments can be implemented with other types of transistors such as BJT. Specifically, in an embodiment, transistors 131 and 133 are N-type MOS (NMOS) transistors, while transistors 132 and 134 are P-type MOS (PMOS) power transistors.

Voltage Vref may be generated by a voltage reference (not shown), and the magnitude of Vref may be chosen based on the desired value of Vout. Voltage Vp represents a source of unregulated power (e.g., a battery) that is sought to be regulated and provided as a regulated voltage on external pin 150 of LDO 100. GND represents a ground terminal. The specific details of FIG. 1 are provided merely by way of illustration. However, several techniques described herein can be applied in other linear regulators as well. Further, only those components of LDO 100 as relevant to the description below are shown in FIG. 1, and LDO may contain other components in addition.

Also shown in FIG. 1 are impedance 147 and capacitor 190. Impedance 147 represents a load, and capacitance 190 is the sum of the capacitance associated with the load and any parasitic capacitance due to wiring (e.g., capacitance associated with a printed circuit board track connecting pin 150 to the load and any intentional capacitance put on the printed circuit board). Resistor 145 represents parasitic resistance due to bond wire connecting the output (available at output node 160) of LDO 100 to external pin 150. LDO 100 may be implemented in integrated circuit (IC) form. In this document, node 160 is referred to as the 'output node', and is distinct from external pin 150, with parasitic resistance 145 present between output node 160 and external pin 150.

Amplifier 110 receives a fraction (as set by feedback block 146, which may be implemented in a known way, such as, for example, a voltage divider using resistors) of the output voltage Vout on the inverting (−) terminal, and Vref on the non-inverting (+) terminal. Amplifier 110 operates to amply the difference between the voltages at the (+) and (−) terminals to generate an amplified error voltage Verr.

Amplified error voltage Verr is applied to the gate terminals of transistor 131 of buffer (A) as well as to the gate terminal of transistor 133 of buffer (B). In response to Verr, buffer (A) generates a corresponding voltage (corresponding to the magnitude of Verr) at the gate terminal of pass transistor 132 to set the ON-resistance of transistor 132. Similarly, buffer (B) generates a voltage corresponding to the magnitude of Verr at the gate terminal of pass transistor 132 to set the ON-resistance of transistor 134. The magnitude of Verr varies with the magnitude of load current IL. Larger the magnitude of load current IL, greater is the value of Verr, and vice-versa. The load current is the sum of the currents passed by pass transistors 132 and 134.

The quiescent current consumed by LDO 100 is the sum of the respective currents consumed by buffer (A), buffer (B) and amplifier 110. The current (Iba) consumed by buffer (A) flows through the path (Vp-resistor 141-transistor 131-non-linear resistance element 142-GND). The current (Ibb) consumed by buffer (B) flows through the path (Vp-resistor 143-transistor 133-resistor 144-GND). The current consumed by amplifier 110 is considered negligible compared to the currents consumed by buffer (A) and buffer (B).

Figure 2:
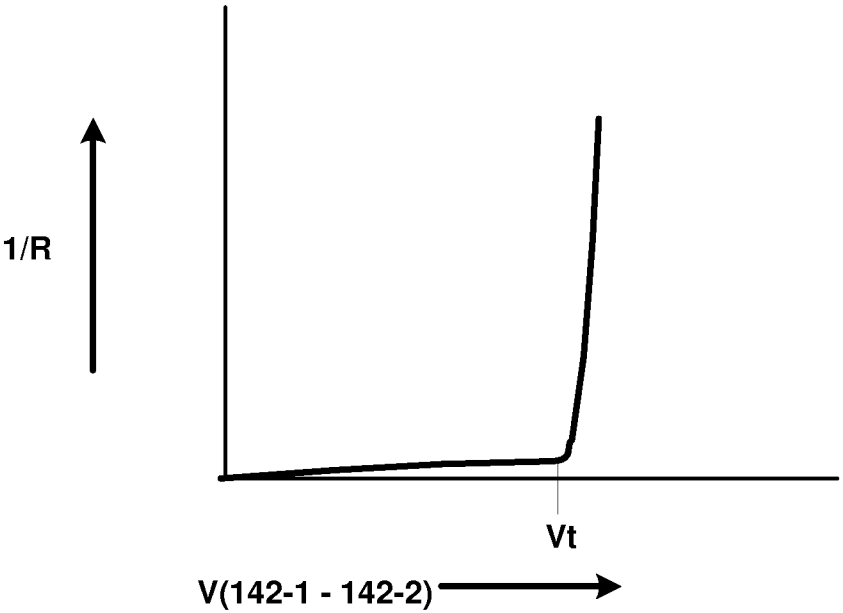
FIG. 2 is a diagram illustrating the relation between cross-terminal voltage and resistance of a non-linear resistance element used in a voltage regulator, in an embodiment.

Non-linear resistance element 142 has the property that for small values of voltage (cross-terminal voltage) across its terminals (142-1 and 142-2), non-linear resistance element 142 has a large resistance. As the voltage across terminals 142-1 and 142-2 increases, the resistance of non-linear resistance element 142 decreases in a non-linear manner. In FIG. 1, terminal 142-2 is connected to ground. FIG. 2 shows the variation of the conductance (1/R) of non-linear resistance element 142 as a function of the voltage across terminals 142-1 and 142-2. As shown in FIG. 2, for voltages less than a threshold Vt across the terminals of non-linear resistance element 142, the resistance of non-linear resistance element 142 is very high. As the voltage crosses Vt, the resistance decreases exponentially. Linear resistance 144 is implemented as a resistor and has a constant resistance (ignoring minor variations due to temperature, etc).

Figure 3A:
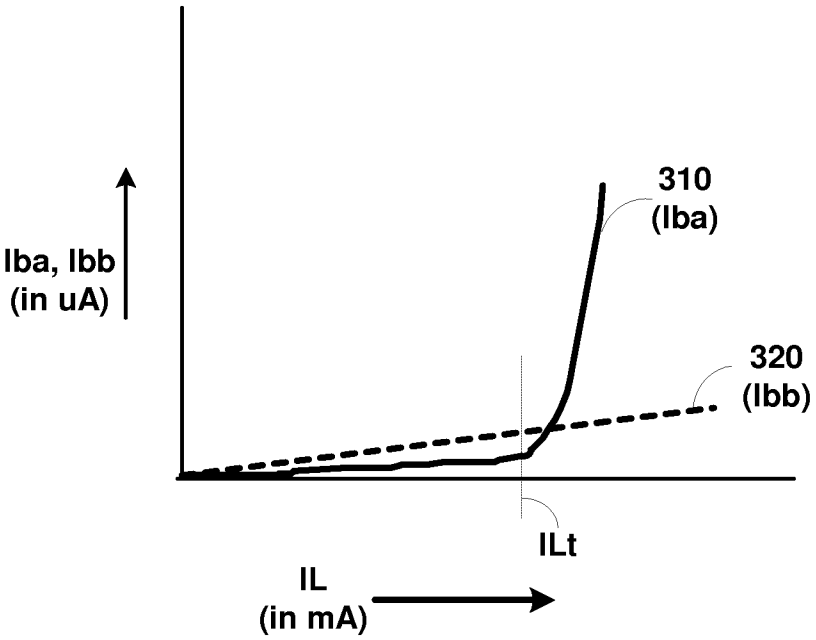
FIG. 3A is a diagram showing the variation of quiescent currents of buffers in a voltage regulator with respect to load current drawn from the voltage regulator, in an embodiment.

FIG. 3A is a diagram showing the variation of quiescent currents Iba and Ibb with respect to load current IL in one embodiment. In FIG. 3A, the x-axis represents IL in milli-Amperes (mA), and the y-axis represents Iba and Ibb (marked respectively as 310 and 320) in micro-Amperes (uA).

For small values of load current IL, Verr is small, and consequently the voltage across non-linear resistance element 142 is small. Hence, the resistance of non-linear resistance element 142 is very high. As a result, for small values of load current IL, the quiescent current (Iba) consumed by buffer (A) is very small (practically negligible), and buffer (A) is practically OFF. Buffer (B) is however always ON, and the load current is supplied by pass transistor 134.

As the load current increases, Verr increases. When load current IL equals a magnitude ILt, the corresponding value of the voltage across terminals 142-1 and 142-2 equals Vt. For values of load current greater than ILt , the voltage across terminals 142-1 and 142-2 is greater than Vt, and the resistance of non-linear resistance element 142 decreases exponentially. Thus, for load currents greater than ILt, the quiescent current (Iba) consumed by buffer (A) increases as shown in FIG. 3, and pass transistor 132 supplies (passes) a substantial portion of the load current (as compared to that supplied by pass transistor 134), with a smaller contribution by pass transistor 134.

Ignoring the current consumed by amplifier 110 as being negligible, the total quiescent current consumed by LDO 100 is the sum of the quiescent currents Iba and Ibb consumed by buffer (A) and buffer (B) respectively. As may be appreciated from FIG. 3A, at low load currents (load currents less than ILt), the total quiescent current consumed by LDO 100 is maintained low. It is only for larger load currents (load currents greater than ILt) that the total quiescent current is comparatively larger. However, even the larger total quiescent current may not pose a problem since at larger load currents, even such increase represents only a small percentage of the load current. Thus, the power consumption of LDO 100 is reduced.

Pass transistor 132 (which is typically implemented as a power MOSFET) may be sized to be large (e.g., with large channel width) to accommodate large values of load current. In comparison, pass transistor 134 (which may also be implemented as a power MOSFET) may be sized to be smaller. In an embodiment of the present invention, ILt is approximately 5 mA, and LDO 100 is designed to support a maximum load current of 350 mA. Thus, for load currents of up to 5 mA, buffer (A) is practically OFF, and buffer (B) provides (via pass transistor 134) substantially the entire load current. For higher load currents (i.e., load currents greater than 5 mA), buffer (A) provides (via pass transistor 132) most of the load current, while the contribution of buffer (B) is comparatively much smaller.

Another advantage with the circuit of FIG. 1 is that LDO 100 is able to better support a step change in the load current if the step change occurs at ILt. Since, when the load switches from ILt to a larger value (e.g., ILt of 5 mA to maximum load current of 350 mA), buffer (B) is already ON and supplying ILt (via pass transistor 134), any drop in output voltage Vout due to slow turn ON of buffer (A) and pass transistor 132 would be smaller than if only a single buffer and a corresponding pass transistor were to be used, as in some prior techniques.

Figure 3B:
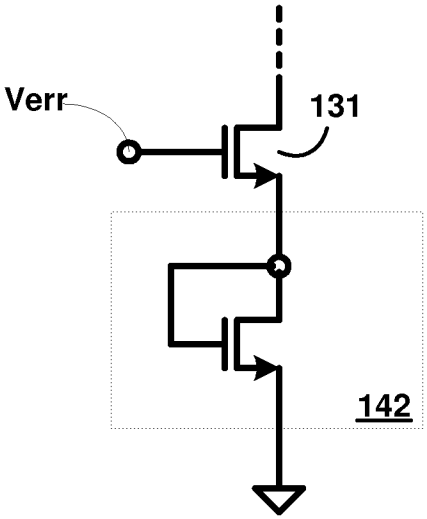
FIG. 3B is a diagram showing a portion of a buffer containing a non-linear resistance element used in a voltage regulator, in an embodiment.

FIG. 3B is a diagram showing transistor 131 and non-linear resistance element 142, in an embodiment. In the embodiment, non-linear resistance element 142 is implemented as diode-connected transistor (i.e., the gate and drain terminals of transistor 142 are tied together), as shown in FIG. 3B.

While only two buffers (A) and (B) are shown in FIG. 1, LDO 100 can be implemented with more number of buffers and corresponding pass transistors, all parallel to each other just like buffer (A) is connected parallel to buffer (B).

According to another aspect of the present invention, improved compensation for stabilizing a voltage regulator is provided, as described next.

3. Compensation

Referring to FIG. 1 again, capacitors 122 (CC2) and 123 (CC3) are provided to improve the stability and transient response of LDO 100. Capacitor CC2 is connected between node 160 and the source terminal of transistor 131. Capacitor CC3 is connected between node 160 and the source terminal of transistor 133. The use of CC2 and CC3 creates two corresponding auxiliary compensation loops, in addition to the main compensation loop via capacitor 121 (CC1) noted below. The use of CC2 and CC3 provides better stability to the corresponding auxiliary compensation loops of LDO 100, increases the bandwidth of LDO 100 and enables better power-supply rejection (PSR), lower total harmonic distortion (THD) and better high-frequency noise performance. The auxiliary compensation loop corresponding to CC2 is the loop formed by [CC2 (122)-transistor 131-resistor 141-transistor 132-CC2 (122)]. The auxiliary compensation loop corresponding to CC3 is the loop formed by [CC3 (123)-transistor 133-resistor 143-transistor 134-CC3 (123)].

Figure 4:
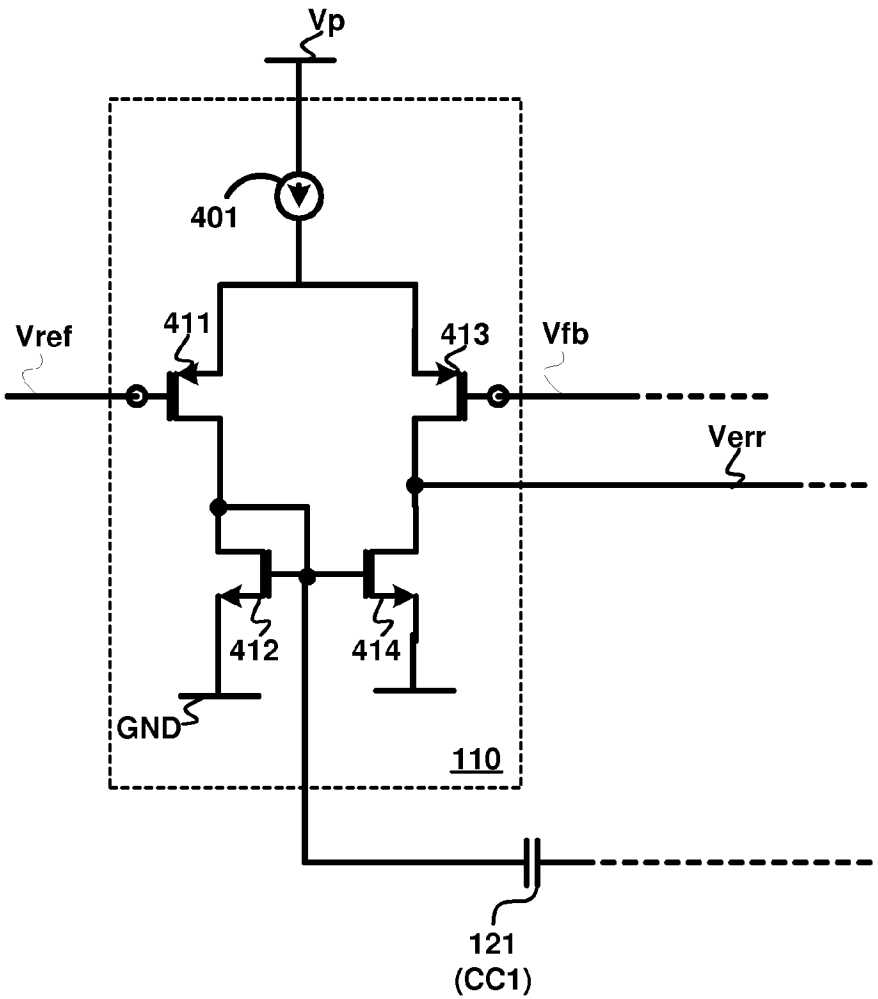
FIG. 4 is a circuit diagram illustrating the internal details of an amplifier used in a voltage regulator, in an embodiment.

In addition to CC2 and CC3, LDO 100 also employs conventional compensation via capacitor 121 (CC1). FIG. 4 shows the internal details of amplifier 110, which is shown containing transistors 411, 412, 413 and 414 and current source 401. The rest of the circuitry of FIG. 1 is not shown in FIG. 4 in the interest of conciseness. Main compensation capacitor CC1 is connected between node 160 and the junction of the gate terminals of transistors 412 and 414, as in a conventional design. The connection to node 160 rather than to pin 150 allows capacitor 190 and parasitic resistance of resistor 145 to be in series connection, which forms a zero in the loop transfer function of the main compensation loop (as well as the two auxiliary compensation loops noted above), and thereby increased stability for each of the compensation loops, as well as higher bandwidth to LDO 100. The main compensation loop noted above is the loop formed by [CC1 (121)-resistor 141-parallel connection formed by buffer (A) and buffer-B)].

Figure 5:
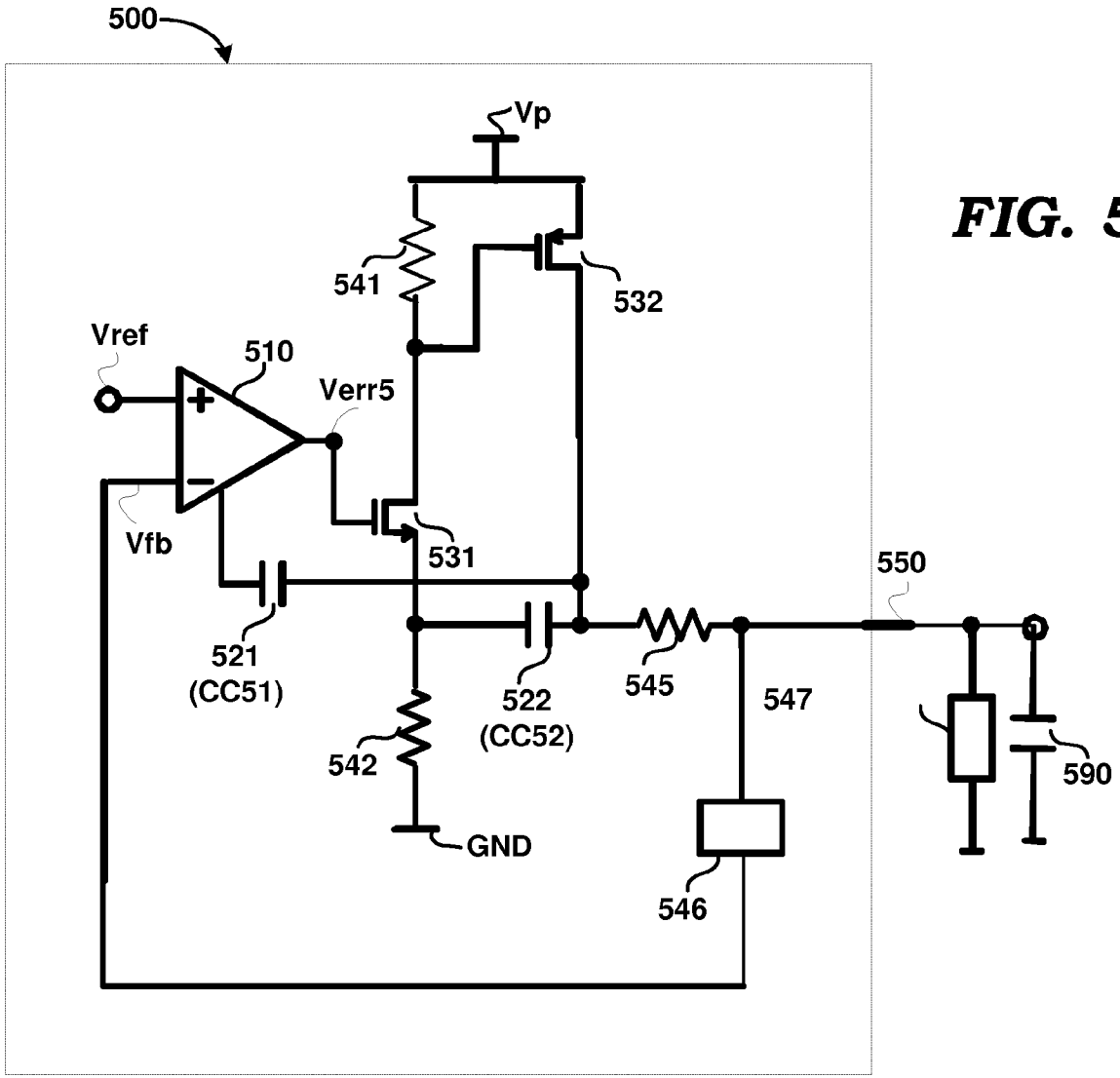
FIG. 5 is a circuit diagram of a voltage regulator in another embodiment of the present invention.

FIG. 5 is a circuit diagram of an LDO in another embodiment of the present invention. LDO 500 is shown containing amplifier 510, transistor 531, resistor 541, resistor 542, feedback block 546, pass transistor 532 and compensation capacitors 521 (CC51) and 552 (CC52). Also shown in FIG. 5 are load 547, load capacitance 590, and parasitic resistance 545.

Amplifier 510, transistor 531, resistor 541, pass transistor 532 and feedback block 546 correspond respectively, and operate similar to amplifier 110, transistor 131, resistor 141, pass transistor 132 and feedback block 146 of FIG. 1, and the description is not repeated here in the interest of conciseness. Resistor 542 is a fixed-value resistor. LDO 500 operates to provide a regulated output voltage on external pin 550. CC51 and CC52 correspond respectively to CC1 and CC2 of FIG. 1, and are provided for stability of corresponding feedback loops in LDO 500, as well as for providing other benefits such as higher bandwidth, better transient response, etc. While only one buffer, formed by transistor 531, resistor 541 and resistor 542, is shown in FIG. 5, in other embodiments, two or more buffers can be used in parallel similar to that shown in FIG. 1.

In the illustrations of FIGS. 1, 4 and 5, although terminals/nodes are shown with direct connections to various other terminals, it should be appreciated that additional components (as suited for the specific environment) may also be present in the path, and accordingly the connections may be viewed as being electrically coupled to the same connected terminals. It should also be appreciated that the specific type of transistors (such as NMOS, PMOS, etc.) noted above with respect to FIGS. 1 and 5 are merely by way of illustration. However, alternative embodiments using different configurations and other types of transistors, such as bipolar junction transistors (BJT) or a combination of MOS and BJT, will be apparent to one skilled in the relevant arts by reading the disclosure provided herein. For example, NMOS transistors and PMOS transistors may be swapped, while also interchanging the connections to power and ground terminals. Accordingly, in the instant application, the source (emitter) and drain (collector) terminals (through which a current path is provided when turned ON and an open path is provided when turned OFF) of transistors are termed as current terminals, and the gate (base) terminal is termed as a control terminal. In the instant application, power supply and ground terminals are referred to as constant reference potentials.

While various embodiments of the present disclosure have been described above, it should be understood that they have been presented by way of example only, and not limitation. Thus, the breadth and scope of the present disclosure should not be limited by any of the above-described embodiments, but should be defined only in accordance with the following claims and their equivalents.

What is claimed is:

1. A voltage regulator to generate a regulated output voltage at an output node, said voltage regulator comprising:

an amplifier to generate an error voltage between a reference voltage and a voltage at said output node;

a first buffer coupled to receive said error voltage and, in response, to drive a first pass transistor, wherein said first buffer includes a non-linear resistance element, wherein a resistance of said non-linear resistance element varies non-linearly with a load current drawn from said output node; and a second buffer coupled to receive said error voltage, and in response, to drive a second pass transistor, wherein said second buffer includes a linear resistance element, wherein a resistance of said linear element is a constant;

wherein when a first load current value drawn from said output node is less than a first threshold, said non-linear resistance element has a resistance value such that a current path from a first reference potential to a second reference potential via said first buffer is cut-off, wherein all of said first load current is passed through said second pass transistor; and, when a second load current value drawn from said output node is greater than said first threshold, said non-linear resistance element has a resistance value such that said current path is provided through said first buffer, wherein said second load current is the sum of the currents passed through said first pass transistor and said second pass transistor.

2. The voltage regulator of claim 1, wherein a first transistor comprised in said first buffer receives said error voltage, wherein said non-linear resistance element is coupled in series with said first transistor.

3. The voltage regulator of claim 2, wherein a second transistor comprised in said second buffer is also coupled to receive said error voltage, wherein said linear resistance element is coupled in series with said second transistor.

4. The voltage regulator of claim 3, said resistance of said non-linear resistance element has a high value when said current path is cut-off, and has a low value when said current path is provided.

5. The voltage regulator of claim 4, further comprising:

a feedback block coupled to receive said voltage at said output node and to generate a fraction of said voltage; and an amplifier to amplify a difference between a reference voltage and said fraction to generate said error voltage.

6. The voltage regulator of claim 3, further comprising:

a first compensation capacitor coupled between said output node and a junction of said non-linear resistance element and said first transistor.

7. The voltage regulator of claim 6, further comprising:

a second compensation capacitor coupled between said output node and a junction of said linear resistance element and said second transistor.

8. The voltage regulator of claim 3, wherein said non-linear resistance element is a diode-connected transistor, and wherein said linear resistance element is a resistor.

9. The voltage regulator of claim 8, wherein said first pass transistor is sized larger than said second transistor.

10. The voltage regulator of claim 9, further comprising a third compensation capacitor coupled between said output node and an internal node of said amplifier.

11. The voltage regulator of claim 1, wherein said error voltage is an amplified difference of said reference voltage and said voltage at said output node.

12. A voltage regulator comprising:

an amplifier with an output terminal, a non-inverting input terminal and an inverting input terminal;

a first buffer comprising a series connection of a first resistor, a first transistor and a non-linear resistance element, wherein a first terminal of said first resistor is coupled to a first constant reference potential representing an unregulated source of power, wherein a second terminal of said first resistor is coupled to a first current terminal of said first transistor, wherein a control terminal of said first transistor is coupled to said output terminal of said amplifier, wherein a second current terminal of said first transistor is coupled to a first terminal of said non-linear resistance element, wherein a second terminal of said non-linear resistance element is coupled to a second constant reference potential;

a second buffer comprising a series connection of a second resistor, a second transistor and a linear resistance element, wherein a first terminal of said second resistor is coupled to said first constant reference potential, wherein a second terminal of said second resistor is coupled to a first current terminal of said second transistor, wherein a control terminal of said second transistor is coupled to said output terminal of said amplifier, wherein a second current terminal of said second transistor is coupled to a first terminal of said linear resistance element, wherein a second terminal of said linear resistance element is coupled to said second constant reference potential;

a first pass transistor, wherein a first current terminal of said first pass transistor is coupled to said first constant reference potential, wherein a control terminal of said first pass transistor is coupled to said second terminal of said first resistor, and wherein a second current terminal of said first pass transistor is coupled to said output terminal;

a second pass transistor, wherein a first current terminal of said second pass transistor is coupled to said first constant reference potential, wherein a control terminal of said first pass transistor is coupled to said second terminal of said second resistor, and wherein a second current terminal of said second pass transistor is coupled to said output terminal; and a feedback block, wherein a first terminal of said feedback block is coupled to said output terminal, wherein a second terminal of said feedback block is coupled to said inverting input terminal, wherein said non-inverting input terminal is coupled to receive a constant reference voltage;

wherein when a first load current value drawn from said output terminal is less than a first threshold, said non-linear resistance element has a resistance value such that a current path from said first constant reference potential to said second constant reference potential via said first buffer is cut-off, wherein all of a load current drawn from said output terminal is passed through said second pass transistor; and, when a second load current value drawn from said output terminal is greater than said first threshold, said non-linear resistance element has a resistance value such that said current path is provided through said first buffer, wherein said load current is the sum of the currents passed through said first pass transistor and said second pass transistor.

13. The voltage regulator of claim 12, further comprising:

a first compensation capacitor coupled between said output terminal and said second current terminal of said first transistor.

14. The voltage regulator of claim 13, further comprising:

a second compensation capacitor coupled between said output terminal and said second current terminal of said second transistor.

15. The voltage regulator of claim 14, further comprising a third compensation capacitor coupled between said output terminal and an internal node of said amplifier.

16. A voltage regulator comprising:

an amplifier with an output terminal, a non-inverting input terminal and an inverting input terminal;

a buffer comprising a series connection of a first resistor, a first transistor and a second resistor, wherein a first terminal of said first resistor is coupled to a first constant reference potential representing an unregulated source of power, wherein a second terminal of said first resistor is coupled to a first current terminal of said first transistor, wherein a control terminal of said first transistor is coupled to said output terminal of said amplifier, wherein a second current terminal of said first transistor is coupled to a first terminal of said second resistor, wherein a second terminal of said resistor is coupled to a second constant reference potential;

a pass transistor, wherein a first current terminal of said pass transistor is coupled to said first constant reference potential, wherein a control terminal of said pass transistor is coupled to said second terminal of said first resistor, and wherein a second current terminal of said pass transistor is coupled to said output terminal;

a feedback block, wherein a first terminal of said feedback block is coupled to said output terminal, wherein a second terminal of said feedback block is coupled to said inverting input terminal, wherein said non-inverting input terminal is coupled to receive a constant reference voltage;

a first compensation capacitor coupled between said output terminal and said second current terminal of said first transistor; and a second compensation capacitor coupled between said output terminal and an internal node of said amplifier;

wherein when a first load current value drawn from said output terminal is less than a first threshold, said non-linear resistance element has a resistance value such that a current path from said first constant reference potential to said second constant reference potential via said buffer is cut-off; and, when a second load current value drawn from said output terminal is greater than said first threshold, said non-linear resistance element has a resistance value such that said current path is provided through said buffer, wherein the current passed through said pass transistor contributes to said load current.

* * * * *

UNITED STATES PATENT AND TRADEMARK OFFICE

CERTIFICATE OF CORRECTION

PATENT NO. : 8,878,510 B2
APPLICATION NO. : 13/472461
DATED : November 4, 2014
INVENTOR(S) : Prasun Kali Bhattacharyya et al.

It is certified that error appears in the above-identified patent and that said Letters Patent is hereby corrected as shown below:

On the Title Page, item [73] should read as follows:

Assignee "Cadence AMS Design India Private Limited, Bangalore, Karnataka (IN)"

Signed and Sealed this
Tenth Day of February, 2015

Michelle K. Lee

Michelle K. Lee
*Deputy Director of the United States Patent and Trademark Office*